US005286617A

United States Patent [19]

Otani et al.

[11] Patent Number: 5,286,617

[45] Date of Patent: Feb. 15, 1994

[54] SILVER HALIDE COLOR PHOTOGRAPHIC MATERIAL

[75] Inventors: Shigeaki Otani; Shoji Ishiguro, both of Kanagawa, Japan

[73] Assignee: Fuji Photo Film Co., Ltd., Kanagawa, Japan

[21] Appl. No.: 896,309

[22] Filed: Jun. 10, 1992

[30] Foreign Application Priority Data

Jun. 12, 1991 [JP] Japan ..... 3-166138

[51] Int. Cl.[5] ..... G03C 1/08

[52] U.S. Cl. ..... 430/508; 430/538; 430/576; 430/588; 430/603

[58] Field of Search ..... 430/538, 603, 508, 588, 430/576

[56] References Cited

U.S. PATENT DOCUMENTS

| | | | |
|---|---|---|---|
| 4,389,455 | 6/1983 | Asao | 430/538 |
| 4,837,140 | 6/1989 | Ikeda et al. | 430/505 |
| 4,921,784 | 5/1990 | Ikeda et al. | 430/603 |
| 5,057,405 | 10/1991 | Shiba et al. | 430/538 |
| 5,135,845 | 8/1992 | MacIntyre et al. | 430/588 |
| 5,183,731 | 2/1993 | Takahashi et al. | 430/505 |
| 5,185,237 | 2/1993 | Kawai | 430/508 |

OTHER PUBLICATIONS

Research Disclosure No. 17643, Dec. 1978.
Research Disclosure No. 18716, Nov. 1979.

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographicmaterial capable of providing an excellent rapid processing property and sharpness as well as forming little stain on a background after processing. The silver halide color photographic light-sensitive material comprises a reflection support provided thereon at least one of each of yellow color developing silver halide emulsion layer, magenta color developing silver halide emulsion layer and cyan color developing silver halide emulsion layer, wherein the spectral sensitivity peaks of the emulsion layers reside in 400 to 490 nm, 530 to 570 nm and 660 to 720 nm, respectively; wherein a silver halide emulsion contained in the cyan color developing silver halide emulsion layer comprises silver halide emulsion comprising silver halide selected from silver chloride, silver bromochloride, silver chloroiodide or silver bromochloroiodide each having an average silver chloride content of 90 mol % or more, and at least one thiocyanic acid salt compound and wherein the spectral sensitivity peak of the cyan color developing silver halide emulsion layer is provided by a J-band absorption of a sensitizing dye represented by the following Formula (I):

Formula (I)

wherein $Z_{23}$ and $Z_{24}$ each represent a group of atoms necessary to form a heterocyclic nucleus selected from a benzothiazole nucleus, a benzoselenazole nucleus, a naphthothiazole nucleus and a naphthoselenazole nucleus, each of which may have at least one substituent selected from a halogen atom, an alkyl group, an alkoxy group, an aryl group, and a hydroxyl group, provided that two of the substituents may be combined with each other to form a ring; $R_{25}$ represents a hydrogen atom, an alkyl group or an aryl group; $R_{23}$ and $R_{24}$ each represent a substituted or unsubstituted alkyl group; $X_{21}$ represents a counter ion; and $n_{21}$ is 0 or 1.

10 Claims, No Drawings

SILVER HALIDE COLOR PHOTOGRAPHIC MATERIAL

FIELD OF THE INVENTION

The present invention relates to a silver halide color photographic material, specifically to a silver halide color photographic material capable of providing an excellent rapid processing property and improved sharpness as well as forming little stain after processing.

BACKGROUND OF THE INVENTION

Commercially available silver halide color photographic materials and associated image forming methods therewith have diverse applications over a wide range of technologies. The capabilities required from these known light-sensitive materials are varied according to the respective applications of the light-sensitive materials, and one such capability is a high density recording property. In order to demonstrate a satisfactory high density recording property in a silver halide color photographic material, high sharpness must be provided. Accordingly, various conventional techniques for increasing the sharpness have been developed and implemented according to the degree of the sharpness requirement for the respective light-sensitive materials.

It is known that halation causes a lowering in sharpness in a light-sensitive material. Two causes of such halation primarily originate from a reflection of incident light at an interface between an emulsion layer and a support or a support and air, and inadvertent irradiation from scattered light attributable to the silver halide grains themselves.

It has been found effective to prevent such deterioration of sharpness by halation to provide a layer containing a white pigment on a support, such as described in, for example, JP-B-58-43734 (the term "JP-B" as used herein means an examined Japanese patent publication), and JP-A-58-17433 (the term "JP-A" as used herein means an unexamined published Japanese patent application), JP-A-58-14830 and JP-A-61-259246. However, problems have been encountered in that the incorporation of white pigment to such an extent as needed to sufficiently improve or preserve optimal sharpness deteriorates the physical strength of the pigment containing layer against so-called folding and that it thus becomes difficult to maintain the smoothness of the layer containing white pigment.

Further, other known methods for improving sharpness include coloring a component layer of a photographic material with a dye, which is described in, for example, U.S. Pat. Nos. 2,548,564 and 3,625,694, JP-A-56-12639 and JP-A-63-197943, European Patent 0337490A2, and JP-A-1-188850. However, it has been found that the increase in content of a dye used for improving sharpness increases white background stain after processing, which makes it impossible to increase an added amount of a dye to such an extent as needed so that the sharpness is sufficiently improved. Stain of a background in a silver halide color photographic material is not commercially acceptable since it not only affects the quality of the background of an image but it also causes color stain in a color image and deteriorates visual sharpness. Particularly, in the case of a reflection type light-sensitive material, the presence of stain is a very important consideration since a reflection density of the stain is theoretically magnified several times by the magnitude of the transmission density and, therefore, even slight stain noticeably deteriorates an image quality.

Meanwhile, a characteristic ever-increasingly required for silver halide color photographic material is amenability to more rapid processing. It is conventionally thought that the silver chloride content of an emulsion is increased for the purpose of improving a rapid processing property. The methods in which an emulsion having a high silver chloride content is used are widely described in, for example, JP-A-58-95345, JP-A-59-232342 and JP-A-60-19140. Also, in the commercial market, emulsions used in color photographic paper are actually going toward and adopting the usage of a higher silver chloride content. A specific absorption range of this high silver chloride emulsion resides in a short wavelength range and has to be subjected to a spectral sensitization in order to absorb a visible ray of a longer wavelength and/or an infrared ray as well for sensitization.

In such a high silver chloride emulsion, however, the problem arises that even if one tries to subject the emulsion to a spectral sensitization with a sensitizing dye ordinarily used for a silver halide emulsion primarily comprising silver bromide, that it is generally difficult to sensitize only to a ray of a specific wavelength.

In efforts to solve this problem, it has already been discovered by the present inventors that a rapid processing property and a sharpness of a silver halide color photographic material can be improved by providing a spectral sensitization with a spectral sensitizing dye which forms a J-aggregate in a high silver chloride emulsion to particularly establish an absorption peak of a certain long wavelength ray in a red spectral sensitization wavelength region (such the absorption peak provided by J-aggregate is called J-band). Meanwhile, it was necessary to develop a technique capable of treating a spectral sensitizing dye added to a high silver chloride emulsion so as to more effectively form the J-aggregate.

SUMMARY OF THE INVENTION

Accordingly, an object of the present invention is to provide a silver halide color photographic material capable of providing an excellent rapid processing property and further providing improved sharpness as well forming less stain after a rapid processing.

As a result of further investigations by the present inventors, it has been discovered that even a spectral sensitizing dye with which it otherwise is difficult to form a J-aggregate in a high silver chloride emulsion while compared to less difficult forming of the J-aggregate in a high silver bromide emulsion, nonetheless can effectively form the J-aggregate by using the spectral sensitizing dye in combination with a thiocyanic acid salt. Further, the J-aggregate can be even more effectively formed by using a thiocyanic acid salt in combination with a spectral sensitizing dye capable of forming the J-aggregate in a high silver chloride content emulsion in particular.

Thus, the above stated and other objects and advantages of the present invention can be effectively achieved by a silver halide color photographic material comprising a reflection support provided thereon at least one of each of a yellow color developing silver halide emulsion layer, a magenta color developing silver halide emulsion layer and a cyan color developing silver halide emulsion layer, wherein the spectral sensitivity peaks of the emulsion layers reside in 400 to 490 nm, 530 to 570 nm and 660 to 720 nm, respectively; and wherein a silver halide emulsion contained in the cyan color developing silver halide emulsion layer comprises (1) a silver halide emulsion comprising silver halide selected from silver chloride, silver bromochloride, silver chloroiodide and silver bromochloroiodide, each having an average silver chloride content of 90 mol % or more, and (2) at least one thiocyanic acid salt compound and wherein the spectral sensitivity peak of the cyan color developing silver halide emulsion layer is provided by a J-band absorption of a sensitizing dye represented by the following Formula (I); as illustrated below. Further, a safelight safety at 590 nm can be improved as well by the present invention and overall improvements can be obtained in terms of improved operability in manufacturing and development processing.

DETAILED DESCRIPTION OF THE INVENTION

As stated previously, the use of a high silver chloride emulsion in general is described in many patent publications, such as JP-A-58-95345, JP-A-59-232342 and JP-A-60-19140. However, no descriptions are disclosed in the above-mentioned publications regarding a sensitizing dye with which the J-aggregate is readily formed when a thiocyanic acid salt is used in combination therewith. Further, nothing is indicated in these publications regarding any effect that the thiocyanic acid salt might have on sharpness. Also, while the combined use of the thiocyanic acid salts with the gold sensitizers in a high silver chloride emulsion is described in, for example, JP-A-64-6941, no descriptions are included therein regarding a sensitizing dye with which the J-aggregate is readily formed when a thiocyanic acid salt is used in combination therewith, and nothing is indicated regarding any effect that a thiocyanic acid salt might have on sharpness. In addition, while several descriptions regarding thiocyanic acid salts are found in JP-A-63-223634, JP-A-1-100533 and JP-A-2-153345, there are no descriptions therein regarding any possible combination of a thiocyanic acid salt with a high silver chloride content emulsion.

The sensitizing dye represented by Formula (I) is explained in greater detail below.

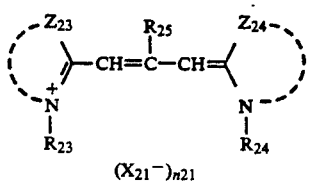

Formula (I)

wherein $Z_{23}$ and $Z_{24}$, which may be the same or different, each represents a group of atoms necessary to form a heterocyclic nucleus selected from a benzothiazole nucleus, a benzoselenazole nucleus, a naphthothiazole nucleus and a naphthoselenazole nucleus each of which may have at least one substituent selected from a halogen atom, an alkyl group, an alkoxy group, an aryl group, and a hydroxyl group, provided that two of the substituents may be combined with each other to form a ring; $R_{25}$ represents a hydrogen atom, an alkyl group or an aryl group; $R_{23}$ and $R_{24}$, which may be the same or different, each represents a substituted or unsubstituted alkyl group; $X_{21}$ represents a counter ion; and $n_{21}$ is 0 or 1. $X_{21}$ can also form an internal salt with $R_{23}$ or $R_{24}$.

In Formula (I), preferred functional group $Z_{23}$ and $Z_{24}$ are a halogen atom such as fluorine, chlorine and bromine, an alkyl group such as methyl, ethyl and propyl, an alkoxy group such as methoxy, ethoxy and propoxy, and an aryl group such as phenyl and p-tolyl group. Preferred as $R_{25}$ are a hydrogen atom, an alkyl group such as methyl, ethyl, propyl, butyl and phenethyl, and an aryl group such as phenyl. Preferred as $R_{23}$ and $R_{24}$ are methyl, ethyl, n-propyl, i-propyl, 2-hydroxyethyl, 4-hydroxybutyl, 2-acetoxyethyl, 3-acetoxypropyl, 2-methoxyethyl, 4-methoxybutyl, 2-carboxyethyl, 3-carboxypropyl, 2-(2-carboxyethoxy) ethyl, 2-sulfoethyl, 3-sulfopropyl, 3-sulfobutyl, 4-sulfobutyl, 2-hydroxy-3-sulfopropyl, 2-(3-sulfopropoxy)ethyl, 2-acetoxy-3-sulfopropyl, 3-methoxy-2-(3-sulfopropoxy)-propyl, 2-[2-(3sulfopropoxy) ethoxy]ethyl, 2-hydroxy-3-(3-sulfopropoxy) propyl, benzyl, and phenethyl.

The ring, which may be formed by combining two of the nuclear substituents is a 5- to 6-membered ring which may contain a hetero atom, provided that a benzene ring is excluded. Also useful is a heterocyclic nucleus formed by condensing such rings, for example, an acetonaphthenothiazole ring and an acetonaphthenoselenazole ring.

A J-band absorption is represented by a light absorption by a J-aggregate. The details of the J-band of a sensitizing dye are described in a well-known treatise in the field, *The Theory of the Photographic Process,* edited by T. H. James, e.g., Chapters 8-9 (1977 ed.).

The compound of the present invention represented by Formula (I) can be incorporated into a silver halide emulsion used for a cyan developing layer by dissolving the dye in an organic solvent such as methanol.

The addition amount of this sensitizing dye compound is not specifically limited. In general, it can be selected in the range of $1\times10^{-6}$ to $1\times10^{-3}$ mole dye per mole of silver halide in an emulsion layer, preferably $1\times10^{-5}$ to $1\times10^{-4}$ mole dye per mole of silver halide in an emulsion layer.

Examples of the compounds represented by Formula (I) are shown below but the present invention is not limited thereto.

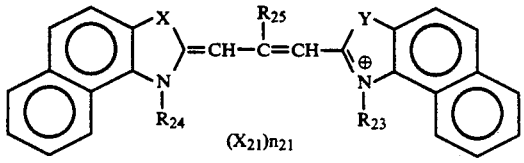

| Compound No. | X | Y | $R_{25}$ | $R_{24}$ | $R_{23}$ | $X_{21}$ | $n_{21}$ |
|---|---|---|---|---|---|---|---|
| I-1 | S | S | $-C_2H_5$ | $-C_2H_5$ | $-C_2H_5$ | $I^{\ominus}$ | 1 |

-continued

| | | | | | | | |
|---|---|---|---|---|---|---|---|
| I-2 | " | " | " | | $-(CH_2)_3SO_3^{\ominus}$ | — | 0 |
| I-3 | " | " | " | $-(CH_2)_3SO_3^{\ominus}$ | " | $\oplus$ $HNEt_3$ | 1 |
| I-4 | " | " | 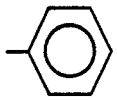 | $-C_2H_5$ | $-C_2H_5$ | $I^{\ominus}$ | 1 |
| I-5 | " | " | " | " | $-(CH_2)_3SO_3^{\ominus}$ | — | 0 |
| I-6 | " | " | " | $-(CH_2)_3SO_3^{\ominus}$ | " | $\oplus$ $HNEt_3$ | 1 |

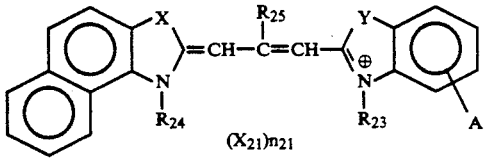

| Compound No. | X | Y | A | $R_{25}$ | $R_{24}$ | $R_{23}$ | $X_{21}$ | $n_{21}$ |
|---|---|---|---|---|---|---|---|---|
| I-7 | S | S | 5-Cl | $-C_2H_5$ | $-C_2H_5$ | $-(CH_2)_3SO_3^{\ominus}$ | — | 0 |
| I-8 | " | " | 5-$OCH_3$ | " | " | " | — | 0 |
| I-9 | " | " | 5-$OCH_3$-6-$CH_3$ | " | " | " | — | 0 |
| I-10 | " | " | 5-Cl | 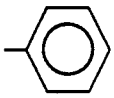 | " | " | — | 0 |
| I-11 | " | " | 5-$OCH_3$ | " | " | " | — | 0 |
| I-12 | " | " | 5-$OCH_3$-6-$CH_3$ | " | " | " | — | 0 |
| I-13 | S | Se | — | $-C_2H_5$ | $-C_2H_5$ | $-C_2H_5$ | $I^{\ominus}$ | 1 |
| I-14 | " | " | — | " | $-C_2H_5$ | $-(CH_2)_3SO_3^{\ominus}$ | — | 0 |
| I-15 | " | " | 5-Cl | " | " | $-C_2H_5$ | $I^{\ominus}$ | 1 |
| I-16 | " | " | " | " | " | $-(CH_2)_3SO_3^{\ominus}$ | — | 0 |
| I-17 | " | " | 5-$CH_3$ | " | " | $-C_2H_5$ | $I^{\ominus}$ | 1 |
| I-18 | S | Se | 5-$CH_3$ | $-C_2H_5$ | $-C_2H_5$ | $-(CH_2)_3SO_3^{\ominus}$ | — | 0 |
| I-19 | " | " | 5-$OCH_3$ | " | " | " | — | 0 |
| I-20 | " | " | 5-OH | " | " | $-C_2H_5$ | $I^{\ominus}$ | 1 |
| I-21 | " | " | " | " | " | $-(CH_2)_3SO_3^{\ominus}$ | — | 0 |
| I-22 | " | " | 5,6-di$CH_3$ | " | " | " | — | 0 |
| I-23 | " | " | 5-Cl | 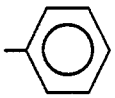 | " | " | — | 0 |
| I-24 | " | " | 5-$OCH_3$ | " | " | " | — | 0 |
| I-25 | " | " | 5-$OCH_3$-6-$CH_3$ | " | " | " | — | 0 |

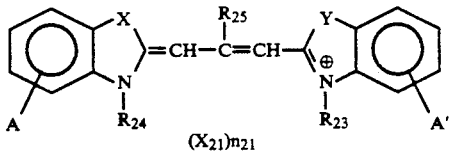

| Compound No. | X | Y | A | A' | $R_{25}$ | $R_{24}$ | $R_{23}$ | $X_{21}$ | $n_{21}$ |
|---|---|---|---|---|---|---|---|---|---|
| I-26 | S | S | 5-Cl | — | 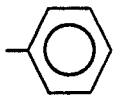 | $-(CH_2)_3SO_3^{\ominus}$ | $-(CH_2)_3SO_3^{\ominus}$ | $\oplus$ $HNEt_3$ | 1 |
| I-27 | " | " | 5-$OCH_3$ | — | " | " | " | " | 1 |
| I-28 | " | " | 5-$OCH_3$ | 5'-$CH_3$ | " | " | " | " | 1 |
| I-29 | Se | Se | — | — | $-C_2H_5$ | $-C_2H_5$ | $-C_2H_5$ | $I^{\ominus}$ | 1 |
| I-30 | " | " | 5-Cl | — | " | " | " | " | 1 |
| I-31 | " | " | 5-$CH_3$ | — | " | " | " | " | 1 |
| I-32 | " | " | 5-OH | — | " | " | " | " | 1 |
| I-33 | " | " | 5-$OCH_3$ | — | " | " | " | " | 1 |
| I-34 | " | " | 5-6-di$CH_3$ | — | " | " | " | " | 1 |
| I-35 | Se | Se | 5-Cl | — | $-C_2H_5$ | $-C_2H_5$ | $-(CH_2)_3SO_3^{\ominus}$ | — | 0 |
| I-36 | " | " | " | 5'-$CH_3$ | " | " | " | — | 0 |

-continued

| | | | | | | | | | |
|---|---|---|---|---|---|---|---|---|---|
| I-37 | " | " | — | — | " | $-(CH_2)_3SO_3^{\ominus}$ | " | $\overset{\oplus}{H}NEt_3$ | 1 |
| I-38 | " | " | 5-Cl | — | " | " | " | " | 1 |
| I-39 | " | " | 5-$CH_3$ | — | " | " | " | " | 1 |
| I-40 | " | " | 5-OH | — | " | " | " | " | 1 |
| I-41 | " | " | 5-$OCH_3$ | — | " | " | " | " | 1 |
| I-42 | " | " | 5-6-di$CH_3$ | — | " | " | " | " | 1 |

I-43

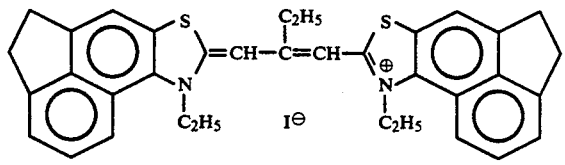

Examples of the thiocyanic acid salt compounds which can be used in the present invention may be either an inorganic salt or an organic salt of thiocyanic acid. There can be exemplified, for example, thiocyanic acid alkali metal salts, such as potassium thiocyanate and sodium thiocyanate; and thiocyanic acid alkali earth salts such as calcium thiocyanate and magnesium thiocyanate; and thiocyanic acid ammonium salts such as ammonium thiocyanate.

The addition amount of the thiocyanic acid salt compound can vary depending on the form and size of the silver halide grains. In general, however, the thiocyanic acid salt can be used in an amount of $2.5\times10^{-5}$ to $2\times10^{-2}$ mole per mole of silver halide in an emulsion layer. Where the size of the silver halide grains is, for example, 0.2 to 1.3 μm, the amount is preferably $1\times10^{-4}$ to $1\times10^{-2}$ mole per mole of silver halide in an emulsion layer.

The thiocyanic acid salt compound used in the present invention is preferably added by dissolving the salt in water as solvent. The timing of the addition of the dissolved salt is not specifically limited and may be either during the formation of the silver halide emulsion itself or the preparation of the emulsion coating solution. The salt is added preferably after the formation of the silver halide grains.

The optical reflection density of a light-sensitive material in the present invention can be measured by a conventional reflection densitometer generally used in the art and defined by the following equation, wherein, in order to avoid a measurement error caused by a light transmitting through a sample, a standard reflection plate is put on a backside of the sample during measuring:

$$\text{Optical reflection density} = \log_{10}(F_0/F)$$

$F_0$: a light flux of a standard white plate.

F: a light flux of a sample.

The optical reflection density value preferably provided to further improve sharpness in the present invention is preferably 0.50 or more, and more preferably in the range of 0.5 to 2.0, in a measuring wavelength of 680 nm. Where it is 2.0 or more, a residual color after processing is liable to become noticeable. The most preferred range is 0.7 to 1.5.

An addition amount of the dye for improving sharpness may be adjusted to obtain an optical reflection density value falling within the above ranges.

These sharpness improving dyes may be used either singly or in a combination of plural kinds thereof. A layer to which the dye is added is not specifically limited, and it can be added to a non-photosensitive layer provided between the lowermost light-sensitive layer and support; or in a light-sensitive emulsion layer, or an intermediate non-photosensitive layer, or a protective layer; and in a non-photosensitive layer provided between a protective layer and the uppermost light-sensitive layer.

The sharpness improving dyes used for achieving the desired optical reflection density property are selected from ones which do not substantially spectrally sensitize a silver halide emulsion. Conventional addition methods can be applied for the addition of these types of dyes. For example, they can be added as dissolved in water or alcohol, such as methanol.

Also, the sharpness improving dyes added to a prescribed layer in this regard may be allowed to diffuse throughout all the layers or may be fixed to a specific source layer(s).

There can be used as the sharpness improving dyes for achieving the manipulation of the optical recording density in the elements of the present invention, various dyes, for example, an oxonol dye having a pyrazolone nucleus or a barbituric acid nucleus, an azo dye, an azomethine dye, an arylidene dye, a styryl dye, a triarylmethane dye, a merocyanine dye, and a cyanine dye.

Among them, the sharpness improving dyes which can be particularly preferably used in the present invention are the dyes described on pages 9 to 71 of the specification of European Patent Publication EP-A-0,337,490 (of them, the oxonol type dyes disclosed therein are preferred).

The silver halide emulsions used in the present invention comprise silver chloride, silver bromochloride, silver chloroiodide or silver bromochloroiodide each having an average silver chloride content of 90 mole % or more, preferably 95 mole % or more. High silver chloride content is preferred for the purpose of facilitating rapid processing of the photographic element.

For the purpose of further improving sharpness of an image, 12% by weight or more of titanium oxide which is subjected to a surface treatment with di- to tetrahydric alcohols (for example, trimethanolethane) and is preferably incorporated into a water-resistant resin containing layer in a light-sensitive material of the present invention.

The photographic additives such as cyan, magenta and yellow couplers which can be used in the present invention are preferably used by dissolving them in a high boiling organic solvent. The high boiling organic solvents can be used as long as they are compounds which have a melting point of 100° C. or lower and a boiling point of 140° C. or higher and are immiscible with water and good solvents for the couplers. The melting point of the high boiling organic solvents is preferably 80° C. or lower. The boiling point of the high boiling organic solvents is preferably 160° C. or higher, more preferably 170° C. or higher.

The details of exemplary high boiling organic solvents in this regard are described in a right lower column of page 137 to a right upper column of page 144 of the specification of JP-A-62-215272.

A cyan, magenta or yellow coupler can be emulsified and dispersed in a hydrophilic colloid aqueous solution by impregnating the couplers into a loadable latex polymer (for example, see U.S. Pat. No. 4,203,716) in the presence or absence of the above high boiling organic solvents, or by dissolving the couplers together with a water insoluble and organic solvent soluble polymer.

As suitable latex polymers in this regard, preferably used are the homopolymers or copolymers described in the 7th to 15th columns of U.S. Pat. No. 4,857,449 and pages 12 to 30 of the specification of International Patent Publication WO88/00723. A methacrylate type or acrylamide type polymer is more preferably used, and the acrylamide type polymer is particularly preferably used in terms of its stabilization of an image.

A color image preservation-improving compound described in U.S. Pat. No. 5,098,805 is preferably used together with a coupler for a light-sensitive material according to the present invention. In particular, it is used preferably in combination with a pyrazoloazole coupler.

A compound (A) which is chemically combined with an aromatic amine type developing agent remaining after a color development processing to form a chemically inactive and substantially colorless compound, and/or a compound (B) which is chemically combined with an oxidation product of an aromatic amine type developing agent remaining after a color development processing to form a chemically inactive and substantially colorless compound, are preferably used singly or in combination to prevent the generation of a stain caused by a dye formed by a reaction of a coupler with a color developing agent or oxidation product thereof remaining in a layer during storage after processing and from other side reactions.

Further, a fungicide described in JP-A-63-271247 may be added to a light-sensitive material according to the present invention in order to prevent various molds and bacterium which grow in a hydrophilic colloid layer and may deteriorate an image.

There may be used as a support material for a light-sensitive material according to the present invention, a white color polyester type support for a display or a support provided with an adjacent layer containing a white pigment on the same of the support side having a silver halide emulsion layer to be exposed. An anti-halation layer is preferably provided on a support side provided with a silver halide emulsion layer or on a backside thereof. In particular, a transmitting density of a support is preferably set within the range of 0.35 to 0.8 so that a display can be seen either with a reflected light or a transmitted light.

In performing exposure, a band stop filter, such as described in U.S. Pat. No. 4,880,726, is preferably used. This device removes light mixing to markedly improve a color reproduction.

An exposed light-sensitive material of the present invention can be subjected to a conventional color development processing. After the color development processing, the light-sensitive material is subjected preferably to a bleach-fixing processing for the purpose of a rapid processing. A bleach-fixing solution preferably has pH of 6.5 or lower, more preferably 6 or lower for the purpose of the acceleration of desilver.

Preferably used in the practice of present invention are the silver halide emulsions, other materials (additives and the like) and photographic component layers (layer sequence arrangement and the like), as modified in a manner and the extent necessary to incorporate the novel features of the light-sensitive material according to the present invention, and also preferably used are the processing methods and processing additives as applied for processing the light-sensitive material of the present invention, each described in the following patent publications, particularly in European Patent 0 355 660A2 (JP-A-2-139544):

TABLE 1

| Photographic elements | JP-A-62-215272 | JP-A-2-33144 | EP 0355660 |
|---|---|---|---|
| Silver halide emulsion | pp. 10, right upper colmn, line 6 to pp. 12, left lower colmn, line 5, and pp. 12, right lower colmn, line 4 from bottom to pp. 13, left upper colmn, line 17. | pp. 28, right upper colmn, line 16 to pp. 29, right lower colmn, line 11, and pp. 30, line 2 to 5 | pp. 45, line 53 to pp. 47, line 3, and pp. 47, line 20 to 22. |
| Silver halide solvent | pp. 12, left lower colmn, line 6 to 14, and pp. 13, left upper colmn, line 3 from bottom to pp. 18, left lower colmn, last line. | — | — |
| Chemical sensitizer | pp. 12, left lower colmn, line 3 from bottom to right lower colmn, line 5 from bottom, and pp. 18, right lower colmn, line 1 to pp. 22, right upper colmn, line 9 from bottom. | pp. 29, right lower colmn, line 12 to last line. | pp. 47, line 4 to 9. |
| Spectral sensitizer (spectral sensitizing method) | pp. 22, right upper colmn, line 8 from bottom to pp. 38, last line. | pp. 30, left upper colmn, line 1 to 13. | pp. 47, line 10 to 15. |
| Emulsion stabilizer | pp. 39, left upper colmn, line 1 to pp. 72, right upper colmn, last line. | pp. 30, left upper colmn, line 14 to right upper colmn, line 1. | pp. 47, line 16 to 19. |

TABLE 1-continued

| Photographic elements | JP-A-62-215272 | JP-A-2-33144 | EP 0355660 |
|---|---|---|---|
| Development accelerator | pp. 72, left lower colmn, line 1 to pp. 91, right upper colmn, line 3. | — | — |
| Color coupler (cyan, magenta and cyan couplers) | pp. 91, right upper colmn, line 4 to pp. 121, left upper colmn, line 6. | pp. 3, right upper colmn, line 14 to pp. 18, left upper colmn, last line, and pp. 30, right upper colmn, line 6 to pp. 35 right lower colmn, line 11. | pp. 4, line 15 to 27, pp. 5, line 30 to pp. 28, last line, and pp. 47, line 23 to pp. 63, line. 50 |
| Color forming accelerator | pp. 121, left upper colmn, line 7 to pp. 125, right upper colmn, line 1. | — | — |
| UV absorber | pp. 125, right upper colmn, line 2 to pp. 127, left lower colmn, last line. | pp. 37, right lower colmn, line 14 to pp. 38, left upper colmn, line 11. | pp. 65, line 22 to 31. |
| Anti-fading agent (an image stabilizer) | pp. 127, right lower colmn, line 1 to pp. 137, left lower colmn, line 8. | pp. 36, right upper colmn, line 12 to pp. 37, left upper colmn, line 19. | pp. 4, line 30 to pp. 5, line 23, pp. 29, line 1 to pp. 45, line 25, pp. 45, line 33 to 40, and pp. 65, line 2 to 21. |
| High boiling and/or low boiling organic solvent | pp. 137, left lower colmn, line 9 to pp. 144, right upper, last line. | pp. 35, right lower colmn, line 14 to pp. 36, left upper, line 4. | pp. 64, line 1 to 51. |
| Method for dispersing photographic additives | pp. 144, left lower colmn, line 1 to pp. 146, right upper colmn, line 7. | pp. 27, right lower colmn, line 10 to pp. 28, left upper column, last line, and pp. 35, right lower colmn, line 12 to pp. 36, right upper colmn, line 7. | pp. 63, line 51 to pp. 64, line 56. |
| Hardener | pp. 146, right upper colmn line 8 to pp. 155, left lower colmn, line 4. | — | — |
| Precursor of a developing agent | pp. 155, left lower colmn, line 5 to right lower colmn, line 2 | — | — |
| Development inhibitor-releasing compound | pp. 155, right lower colmn, line 3 to 9. | — | — |
| Support | pp. 155, right lower colmn, line 19 to pp. 156, left upper colmn, line 14. | pp. 38, right upper colmn, line 18 to pp. 39, left upper colmn, line 3. | pp. 66, line 29 to pp. 67 line 13. |
| Light-sensitive layer structure | pp. 156, left upper colmn, line 15 to right lower colmn, line 14. | pp. 28, right upper colmn, line 1 to 15. | pp. 45, line 41 to 52 |
| Dye | pp. 156, right lower colmn, line 15 to pp. 184, right lower colmn, last line. | pp. 38, left upper colmn, line 12 to right upper colmn, line 7. | pp. 66, line 18 to 22. |
| Anit-color mixing agent | pp. 185, left upper colmn, line 1 to pp. 188, right lower colmn, line 3. | pp. 36, right upper colmn, line 8 to 11. | pp. 64, line 57 to pp. 65 line 1. |
| Gradation controller | pp. 188, right lower colmn, line 4 to 8. | — | — |
| Anti-stain agent | pp. 188, right lower colmn, line 9 to pp. 193, right lower colmn, line 10. | pp. 37, left upper colmn, last line to right lower colmn, line 13. | pp. 65, line 32 to pp. 66, line 17. |
| Surface active agent | pp. 201, left lower colmn, linel to pp. 210, right upper colmn, last line | pp. 18, right upper colmn, line 1 to pp. 24, right lower colmn, last line, and pp. 27, left lower colmn, line 10 from bottom to right lower colmn, line 9. | — |
| Fluorinated compound (antistatic agent, coating aid, lubricant and antiadhesion agent) | pp. 210, left lower colmn, line 1 to pp. 222, left lower colmn, line 5. | pp. 25, left upper colmn, line 1 to pp. 27, right lower colmn, line 9. | — |
| Binder (hydro-philic colloid) | pp. 222, left lower colmn, line 6 to pp. 225, left upper colmn, last line. | pp. 38, right upper colmn, line 8 to 18. | pp. 66, line 23 to 28. |
| Thickener | pp. 225, right upper colmn, | — | — |

TABLE 1-continued

| Photographic elements | JP-A-62-215272 | JP-A-2-33144 | EP 0355660 |
|---|---|---|---|
| | line 1 to pp. 227, right upper colmn, line 2. | | |
| Antistatic agent | pp. 227, right upper colmn, line 3 to pp. 230, left upper colmn, line 1. | — | — |
| Polymer latex | pp. 230, left upper colmn, line 2 to pp. 239, last line | — | — |
| Matting agent | pp. 240, left upper colmn, line 1 to right upper colmn, last line. | — | — |
| Photographic processing method (processing steps and additives) | pp. 3, right upper colmn, line 7 to pp. 10, right upper colmn, line 5. | pp. 39, left upper colmn, line 4 to pp. 42, left upper colmn, last line. | pp. 67, line 14 to pp. 69, line 28. |

Remarks:
1. There is included in the cited items from JP-A-62-215272, the content amended according to the Amendment of March 16, 1987 which has been published on September 21, 1987.
2. Of the above color couplers, also preferably used are the so-called short wave type yellow couplers described in JP-A-63-231451, JP-A-63-123047, JP-A-63-241547, JP-A-1-173499, JP-A-1-213648, and JP-A-1-250944.

Preferably used as a cyan coupler, are the 3-hydroxypyridine type couplers described in European Patent 0,333,185A2 (among them, particularly preferred are a coupler converted to a diequivalent coupler by providing tetraequivalent Coupler (42) listed as a specific example with a chlorine releasing group, Coupler (6), and Coupler (9)), and the cyclic active methylene type cyan couplers described in JP-A-64-32260 (of them, particularly preferred are Couplers 3, 8 and 34 listed as a specific examples), as well as the diphenyl imidazole type cyan couplers described in JP-A-2-33144.

The method described in a left upper column of page 27 to a right upper column of page 34 of JP-A-2-207250 is preferably applied as a processing method for a silver halide color light-sensitive material in which a high silver chloride emulsion having a silver chloride content of 90 mole % or more is used.

The present invention will be explained below in greater detail with reference to the examples but is not to be construed as limited thereto.

EXAMPLE 1

Preparation of Emulsion A 3.3 g of Sodium chloride was added to a 3% aqueous solution of lime-treated gelatin and 3.2 ml of N,N'-dimethylimidazolidine-2-thione (1% aqueous solution) 3.2 ml was further added thereto. An aqueous solution containing 0.5 mole of silver nitrate and an aqueous solution containing 0.5 mole of sodium chloride were added to this solution at 66° C. while vigorously stirring. Then, an aqueous solution containing 0.45 mole of silver nitrate and an aqueous solution containing 0.5 mole of sodium chloride were added thereto at 66° C. while vigorously stirring. The emulsion thus prepared was subjected to a desalting by adding a copolymer of isobutene and maleic acid, followed by settling and washing. Further, 90.0 g of lime-treated gelatin was then added and pH and pAg were adjusted to 6.2 and 6.5, respectively. A silver bromide fine grain emulsion having a grain size of 0.05 μm was added at 50° C. to this emulsion in terms of a silver amount of 0.005 mole to form a silver bromide rich layer on the grain surfaces, and then, a red-sensitive sensitizing dye (S-1) $2\times10^{-4}$ mole/mole of Ag and potassium thiocyanate $2\times10^{-3}$ mole/mole of Ag, followed by further adding a sulfur sensitizer (triethyl thiourea) in an amount of $1\times10^{-5}$ mole/mole of Ag and nucleic acid 0.2 g/mole of Ag to thereby optimumly provide a chemical sensitization. 0.8 mg Potassium hexachloro-iridate (IV) per 0.005 mole of the grains was incorporated in advance into the above silver bromide fine grains during the formation thereof.

A grain form, a grain size and a grain size distribution of the silver bromochloride of Emulsion A having a silver chloride content of 99.5 mole % were obtained from an electroscopic photograph thereof. The silver halide grains were of cube form, and a grain size and coefficient of variation were 0.50 μm and 0.08, respectively. The grain size was defined by an average value of the diameters of the circles having the same areas as the projected areas of the grains, and the grain size distribution was defined by the value obtained by dividing a standard deviation of a grain size with an average grain size.

Emulsions B to K shown in Table 1 were prepared generally like emulsion A, at the same reaction temperature and using the silver bromochloride having the same grain size, except that the red sensitizing dye and thiocyanic acid salt were changed as shown in Table 1.

Further, the silver halide grains in Emulsions B through K were prepared at different temperatures from Emulsion A to form emulsions having different grain sizes, and then blue-sensitive sensitizing dyes or green-sensitive sensitizing dyes, as described below, were added respectively to prepare a blue-sensitive emulsion, which was used in a First Layer described below, and a green-sensitive emulsion, which was used in a Third Layer described below.

A sensitizing dye A for the blue-sensitive emulsion

-continued

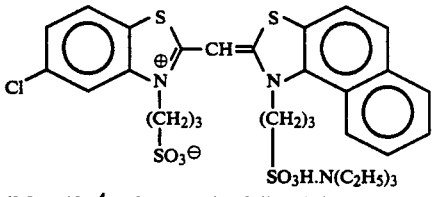

(2.0 × $10^{-4}$ mole per mole of silver halide)

A sensitizing dye B for the blue-sensitive emulsion

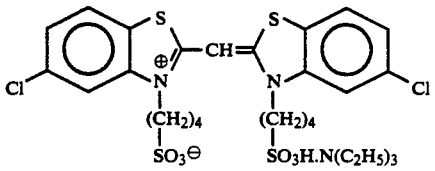

(2.0 × $10^{-4}$ mole per mole of silver halide)

A sensitizing dye C for the green-sensitive emulsion

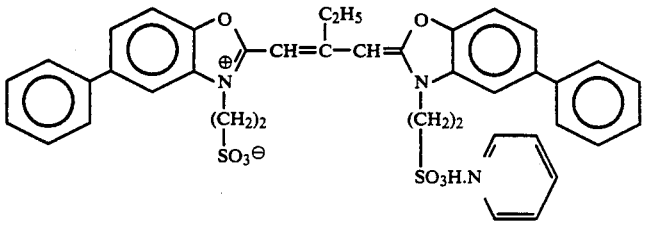

(4.0 × $10^{-4}$ mole per mole of silver halide)

A sensitizing dye D for a green-sensitive emulsion

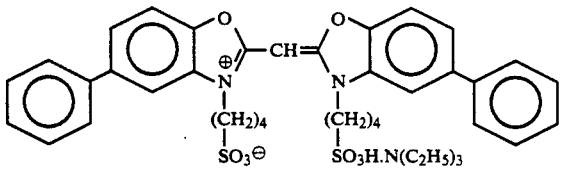

(7.0 × $10^{-5}$ mole per mole of silver halide)

A surface of a paper support laminated with polyethylene on both sides thereof was subjected to a corona discharge treatment, and then a gelatin subbing layer containing dodecylbenzenesulfonic acid was provided thereon. Further, various photographic component layers were coated thereon to thereby prepare a multilayered color printing paper i,e.; Sample (O) having a layer structure shown below. The coating solutions were prepared as described below.

PREPARATION OF THE FIFTH LAYER COATING SOLUTION 25.0 ml of Ethyl acetate and 4.2 g of a solvent (Solv-6) were added to 9.6 g of a cyan coupler (ExC), 0.6 g of a dye image stabilizer (Cpd-2), 5.4 g of a dye image stabilizer (Cpd-6), 12 g of a dye image stabilizer (Cpd-7), 1.5 g of a dye image stabilizer (Cpd-8), and 0.4 g of a dye image stabilizer (Cpd-4) to dissolve them. This solution was emulsified and dispersed in 402 ml of a 10% gelatin aqueous solution containing 20.0 ml of 10% sodium dodecylbenzenesulfonate, whereby an emulsion C was prepared. This was mixed with the above silver bromochloride Emulsion A (cube, an average grain size: 0.50 μm) to thereby prepare the fifth layer coating solution so that the composition thereof became as shown Below.

The coating solutions for the first layer to seventh layer were prepared as well in the similar manners to the fifth layer coating solution. Sodium 1-oxy-3,5-dichloro-s-triazine was used as a gelatin hardener for the respective layers. The total coated amount of this coating solution was 0.097 g/$m^2$.

Further, Cpd-10 and Cpd-11 were added to each coating solution so that their total added amounts became 25.0 g/$m^2$ and 50.0 g/$m^2$, respectively.

1-(5-methylureidophenyl)-5-mercaptotetrazole was added to the blue-sensitive emulsion layer, the green-sensitive emulsion layer and the red-sensitive emulsion layer in the amounts of $8.5\times10^{-5}$ mole, $7.7\times10^{-4}$ mole and $2.5\times10^{-4}$ mole each per mole of silver halide, respectively.

Further, 4-hydroxy-6-methyl-1,3,3a,7-tetraazaindene was added to the blue-sensitive emulsion layer and the green-sensitive emulsion layer in the amounts of $1\times10^{-4}$ mole and $2\times10^{-4}$ mole each per mole of silver halide, respectively.

The following dyes Dye-1 to Dye-4 (the numbers in the parentheses represent the coated amounts) were each applied to each of the emulsion layers (First, Third, and Fifth Layers) in order to prevent irradiation.

(Dye-1)

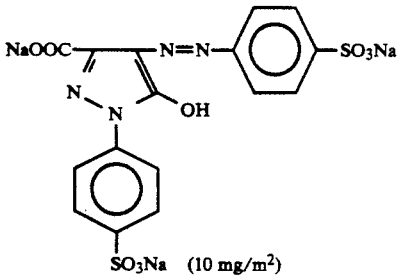

(Dye-2)

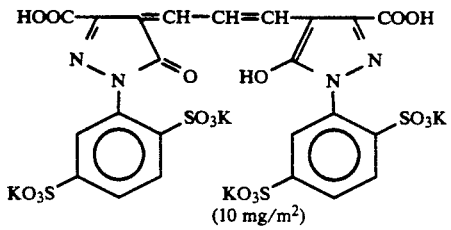

(Dye 3)

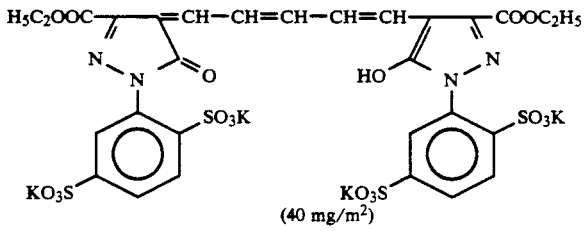

(Dye 4)

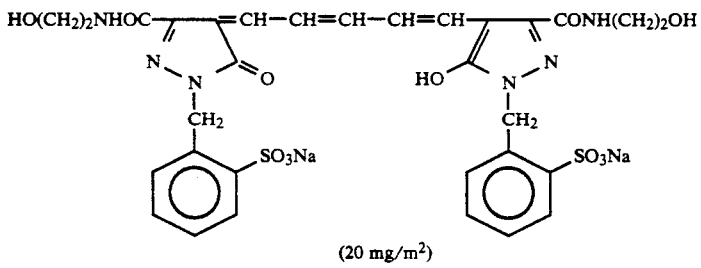

Samples (1) to (23) shown in Table 1 were prepared in the same manner as that of Sample (O) described below, except that an addition amount of anti-irradiation dye (Dye-3) and a type of red-sensitive sensitizing dye and a type, if any, of thiocyanic acid salt added to the silver chlorobromide emulsion layer contained in the Fifth layer (red sensitive cyan developing layer) in each of Samples (1) to (23) were varied as shown in Table 1. The red-sensitizing dyes used in this regard are described below.

(S-1)

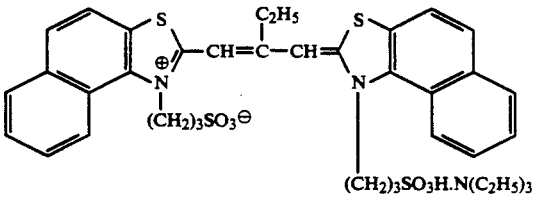

Comparative dye (S-2)

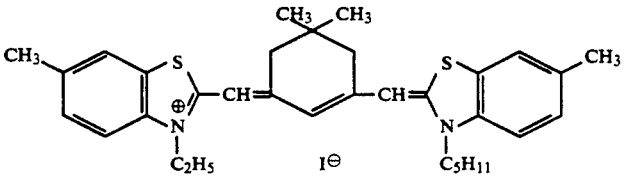

-continued (S-3)

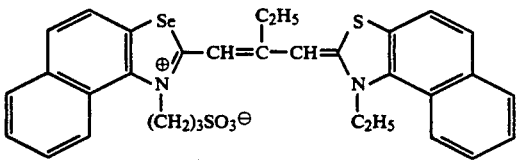

(S-4)

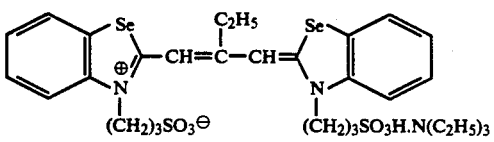

(S-5)

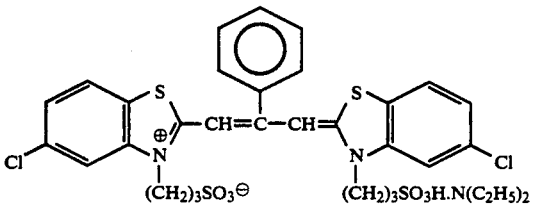

TABLE 1

| Sample No. | Emulsion | Sensitizing dye Kind*9 | Thiocyanate*1 Kind | Thiocyanate*1 Added amount*2 | Dye 3 added amount*3 | Density*4 |
|---|---|---|---|---|---|---|
| 1 (Comp.) | B | S-2 (Comparison) | — | — | — | 0.3 |
| 2 (Comp.) | B | S-2 (Comparison) | — | — | 5 | 0.5 |
| 3 (Comp.) | B | S-2 (Comparison) | — | — | 35 | 1.0 |
| 4 (Comp.) | B | S-2 (Comparison) | — | — | 80 | 2.0 |
| 5 (Comp.) | C | S-2 (Comparison) | PT*5 | 1.0 | — | 0.3 |
| 6 (Comp.) | C | S-2 (Comparison) | PT | 1.0 | 35 | 1.0 |
| 7 (Comp.) | C | S-2 (Comparison) | PT | 1.0 | 80 | 2.0 |
| 8 (Comp.) | D | S-1 | — | — | — | 0.3 |
| 9 (Comp.) | D | S-1 | — | — | 5 | 0.5 |
| 10 (Comp.) | D | S-1 | — | — | 35 | 1.0 |
| 11 (Comp.) | D | S-1 | — | — | 80 | 2.0 |
| 12 (Inv.) | E | S-1 | PT | 1.0 | — | 0.3 |
| 13 (Inv.) | E | S-1 | PT | 1.0 | 5 | 0.5 |
| 14 (Inv.) | E | S-1 | PT | 1.0 | 15 | 0.7 |
| 15 (Inv.) | E | S-1 | PT | 1.0 | 35 | 1.0 |
| 16 (Inv.) | E | S-1 | PT | 1.0 | 80 | 2.0 |
| 17 (Inv.) | A | S-1 | PT | 5.0 | 5 | 0.5 |
| 18 (Inv.) | F | S-3 | PT | 1.0 | 5 | 0.5 |
| 19 (Inv.) | G | S-4 | PT | 1.0 | 5 | 0.5 |
| 20 (Inv.) | H | S-5 | PT | 1.0 | 5 | 0.5 |
| 21 (Inv.) | I | S-1 | AT*6 | 1.0 | 5 | 0.5 |
| 22 (Inv.) | J | S-1 | ST*7 | 1.0 | 5 | 0.5 |
| 23 (Inv.) | K | S-1 | CT*8 | 1.0 | 5 | 0.5 |

*1thiocyanic acid salt was added dissolved in water.
*2$\times 10^{-3}$ mole/mole of Ag.
*3mg/m$^2$.
*4optical reflection density in 680 nm.
*5potassium thiocyanate.
*6ammonium thiocyanate.
*7sodium thiocyanate.
*8calcium thiocyanate.
*9amount of the sensitizing dyes is equimolar with S-1 in the Emulsion A.

LAYER STRUCTURE

The compositions of the respective layers are shown below. The numbers represent the coated amounts (g/m$^2$). The amount of a silver halide emulsion is expressed by the amount converted to silver.

SUPPORT

Polyethylene-laminated paper (a white pigment-/$TiO_2$ and bluing dye (ultramarine) were added to polyethylene on the side of the first layer).

| First layer (blue-sensitive yellow developing layer): | |
|---|---|
| Above silver chlorobromide emulsion (A) | 0.30 |
| Gelatin | 1.22 |
| Yellow coupler (ExY) | 0.82 |
| Image stabilizer (Cpd-1) | 0.19 |
| Solvent (Solv-3) | 0.18 |
| Solvent (Solv-7) | 0.18 |

-continued

| | |
|---|---|
| Image stabilizer (Cpd-7) | 0.06 |
| Second layer (anti-color mixing layer): | |
| Gelatin | 0.64 |
| Anti-color mixing agent (Cpd-5) | 0.10 |
| Solvent (Solv-1) | 0.16 |
| Solvent (Solv-4) | 0.08 |
| Third layer (green-sensitive magenta developing layer): | |
| Silver chlorobromide emulsion (A) | 0.12 |
| Gelatin | 1.28 |
| Magenta coupler (ExM) | 0.23 |
| Image stabilizer (Cpd-2) | 0.03 |
| Image stabilizer (Cpd-3) | 0.16 |
| Image stabilizer (Cpd-4) | 0.02 |
| Image stabilizer (Cpd-9) | 0.02 |
| Solvent (Solv-2) | 0.40 |
| Fourth layer (UV absorbing layer): | |
| Gelatin | 1.41 |
| UV absorber (UV-1) | 0.47 |
| Anti-color mixing agent (Cpd-5) | 0.05 |
| Solvent (Solv-5) | 0.24 |
| Fifth layer (red-sensitive cyan developing layer): | |
| Silver chlorobromide emulsion (A) | 0.23 |
| Gelatin | 1.04 |
| Cyan coupler (ExC) | 0.32 |
| Image stabilizer (Cpd-2) | 0.03 |
| Image stabilizer (Cpd-4) | 0.02 |
| Image stabilizer (Cpd-6) | 0.18 |
| Image stabilizer (Cpd-7) | 0.40 |
| Image stabilizer (Cpd-8) | 0.05 |
| Solvent (Solv-6) | 0.14 |
| Sixth layer (UV absorbing layer): | |
| Gelatin | 0.48 |
| UV absorber (UV-1) | 0.16 |
| Anti-color mixing agent (Cpd-5) | 0.02 |
| Solvent (Solv-5) | 0.08 |
| Seventh layer (protective layer): | |
| Gelatin | 1.10 |
| Acryl-modified copolymer of polyvinylalcohol (modification: 17%) | 0.17 |
| Fluid paraffin | 0.03 |

Yellow coupler (ExY)

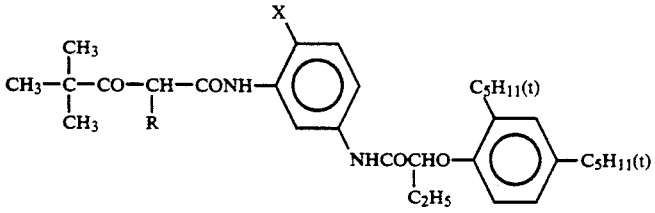

the mixture (1:1 by mole) of

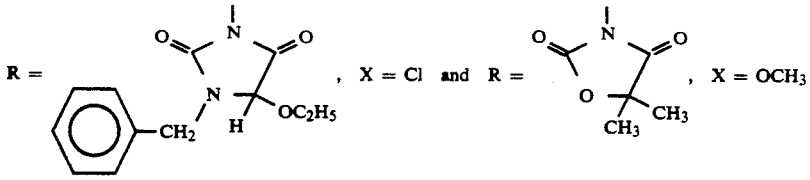

Magenta coupler (ExM)

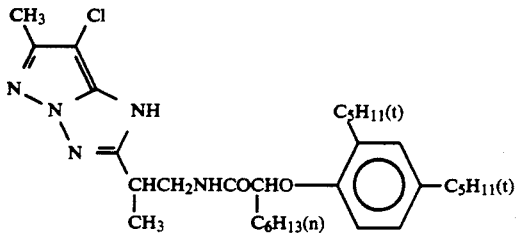

Cyan coupler (ExC)
the mixture (1:1 by mole) of

-continued
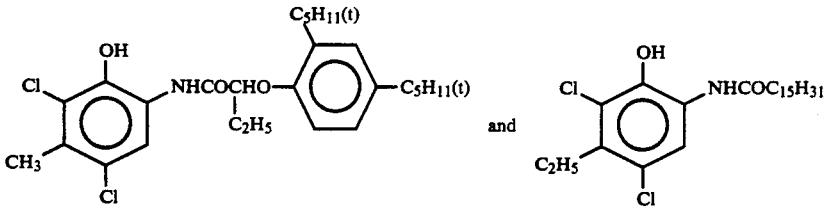
Image stabilizer (Cpd-1)
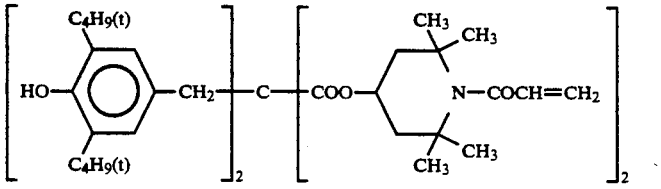
Image stabilizer (Cpd-2)
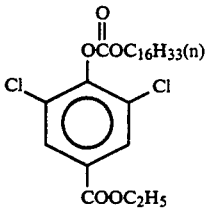
Image stabilizer (Cpd-3)
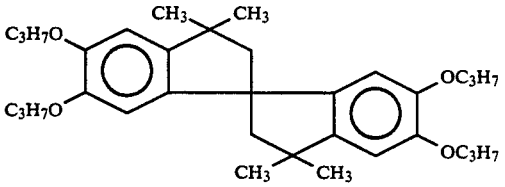
Image stabilizer (Cpd-4)
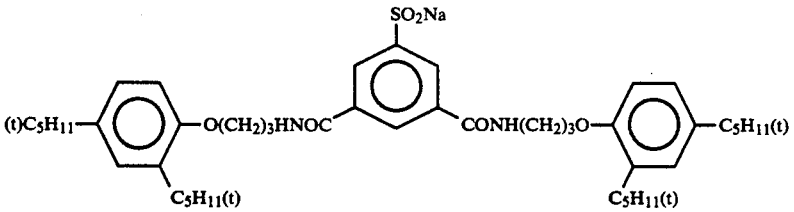
Anti-color mixing agent (Cpd-5)
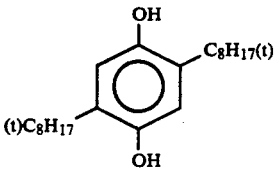
Image stabilizer (Cpd-6)
the mixture (2:4:4 by weight) of -continued
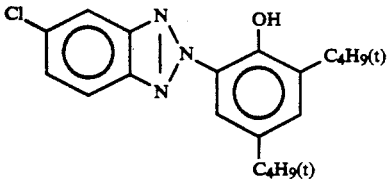
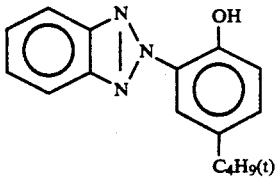
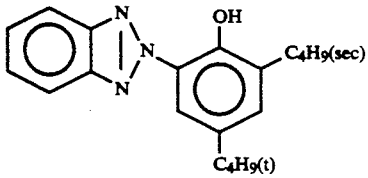
Image stabilizer (Cpd-7)
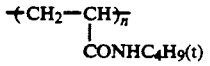
(Average molecular weight: 60,000)
Image stabilizer (Cpd-8)
the mixture (1:1 by mole) of
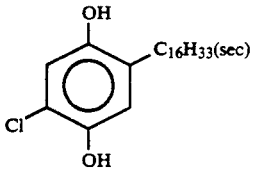
and
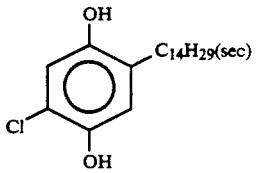
Image stabilizer (Cpd-9)
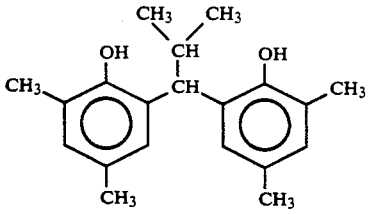
Preservative (Cpd-10)
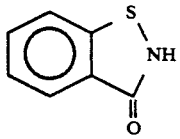
Preservative (Cpd-11)
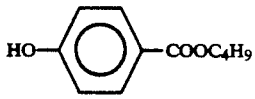
UV absorber (UV-1)
the mixture (4:2:4 by weight) of
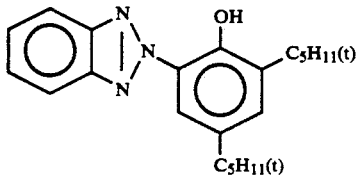
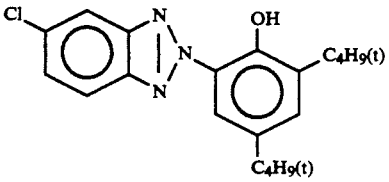

-continued

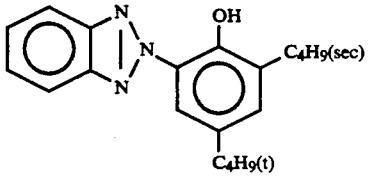

Solvent (Solv-1)

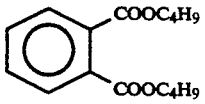

Solvent (Solv-2)
the mixture (1:1 by volume) of

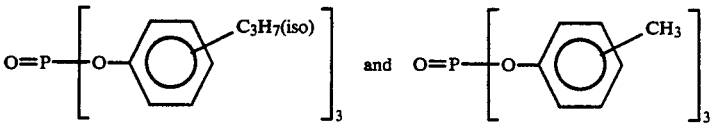

Solvent (Solv-3)
$O{=}P{+}O{-}C_9H_{19}(iso)]_3$

Solvent (Solv-4)

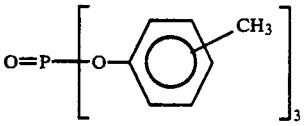

Solvent (Solv-5)

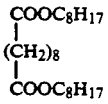

Solvent (Solv-6)
the mixture (80:20 by volume) of

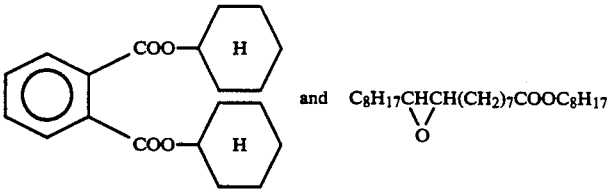

Solvent (Solv-7)

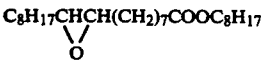

DEVELOPMENT PROCESSING

The exposed samples were subjected to a continuous processing (a running test) with a paper processing machine at the following processing steps until a replenishing quantity of a color developing solution reached two times the tank capacity thereof.

| Processing step | Temperature | Time | Replenishing amount* | Tank capacity |
|---|---|---|---|---|
| Color developing | 35° C. | 45 sec | 161 ml | 17 liter |
| Bleach-fixing | 30 to 35° C. | 45 sec | 215 ml | 17 liter |
| Rinsing (1) | 30 to 35° C. | 20 sec | — | 10 liter |
| Rinsing (2) | 30 to 35° C. | 20 sec | — | 10 liter |
| Rinsing (3) | 30 to 35° C. | 20 sec | 350 ml | 10 liter |

-continued

| Processing step | Temperature | Time | Replenishing amount* | Tank capacity |
|---|---|---|---|---|
| Drying | 70 to 80° C. | 60 sec | | |

*The replenishing amount is expressed in terms of per $m^2$ of a light-sensitive material.

Rinsing was carried out in a three tanks countercurrent system from rinsing steps (3) to (1).

The compositions of the respective processing solutions are as follows:

| | Tank Solution | Replenishing solution |
|---|---|---|
| Color developing solution | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(b-methanesulfonamidethyl)-3-methyl 4-aminoaniline sulfate | 5.0 g | 7.0 g |
| N,N-bis(carboxymethyl) hydrazine | 4.0 g | 5.0 g |
| Monosodium N,N-di(sulfoethyl) hydroxylamine | 4.0 g | 5.0 g |
| Fluorescent whitening agent (Whitex 4B, manufactured by Sumitomo Chemical Ind. Co., Ltd.) | 1.0 g | 2.0 g |
| Water was added to | 1000 ml | 1000 ml |
| pH (25° C.) | 10.05 | 10.45 |
| Bleach-fixing solution (a tank solution is the same as a replenishing solution) | | |
| Water | 400 ml | |
| Ammonium thiosulfate (700 g/liter) | 100 ml | |
| Sodium sulfite | 17 g | |
| Iron (III) ammonium ethylenediaminetetracetate | 55 g | |
| Disodium ethylenediaminetetracetate | 5 g | |
| Ammonium bromide | 40 g | |
| Water was added to | 1000 ml | |
| pH (25° C.) | 6.0 | |
| Rinsing solution (a tank solution is the same as a replenishing solution) | | |
| Ion exchanged water (the contents of calcium and magnesium: each 3 ppm or lower) | | |

Samples (1) to (23) were subjected to an evaluation of sharpness and stain on a white background after processing as follows.

A value called CTF was used for the evaluation of a sharpness, wherein CTF represents a decay of an amplitude against a spatial frequency as a square wave. In the present invention, the sharpness was shown in terms of the spatial frequency of 15 lines/mm. The greater the value, the higher the sharpness.

The evaluation of a stain was expressed by the difference of the white light densities on a background, which were measured before (immediately after processing) and after a sample subjected to a development processing was stored in the conditions of 60° C. and RH 70% for seven days.

The results are shown in Table 2.

TABLE 2

| Sample No. | CTF (R) | Stain: Immediately after processing | Stain: After storage*1 |
|---|---|---|---|
| 1 (Comp.) | 0.10 | 0.02 | 0.03 |
| 2 (Comp.) | 0.12 | 0.02 | 0.03 |
| 3 (Comp.) | 0.14 | 0.02 | 0.03 |
| 4 (Comp.) | 0.18 | 0.02 | 0.03 |
| 5 (Comp.) | 0.10 | 0.04 | 0.05 |
| 6 (Comp.) | 0.14 | 0.04 | 0.07 |
| 7 (Comp.) | 0.18 | 0.06 | 0.10 |
| 8 (Comp.) | 0.18 | 0.02 | 0.03 |
| 9 (Comp.) | 0.20 | 0.02 | 0.03 |
| 10 (Comp.) | 0.23 | 0.02 | 0.03 |
| 11 (Comp.) | 0.25 | 0.03 | 0.04 |
| 12 (Inv.) | 0.32 | 0.02 | 0.03 |
| 13 (Inv.) | 0.40 | 0.02 | 0.03 |
| 14 (Inv.) | 0.42 | 0.02 | 0.03 |
| 15 (Inv.) | 0.44 | 0.02 | 0.03 |
| 16 (Inv.) | 0.45 | 0.03 | 0.04 |
| 17 (Inv.) | 0.42 | 0.02 | 0.03 |
| 18 (Inv.) | 0.42 | 0.02 | 0.03 |
| 19 (Inv.) | 0.42 | 0.02 | 0.03 |
| 20 (Inv.) | 0.42 | 0.02 | 0.03 |
| 21 (Inv.) | 0.42 | 0.02 | 0.03 |
| 22 (Inv.) | 0.42 | 0.02 | 0.03 |
| 23 (Inv.) | 0.42 | 0.02 | 0.03 |

*1 at 60° C. and RH 70% for seven days.

Where comparative sensitizing dye S-2 is used, as in Samples 1 to 7, it led to a relatively small and significantly inferior improvement in sharpness in comparison to Sample Nos. 12–23 not withstanding any increase in addition amount of the anti-irradiation Dye-3 to raise optical reflection density of the light-sensitive material. Further, where a thiocyanic acid salt was used in combination with comparative sensitizing dye S-2, a stain which looks like fog appears immediately after processing, as in Sample Nos. 5–7, and where the amount of anti-irradiation Dye-3 is further increased, as in Sample No. 7, the stain after storage was increased to an even larger extent.

Where the sensitizing dye S-1, which is represented by Formula (I), was used in Samples 8 to 11 but without a thiocyanic acid salt, the improvement in sharpness is somewhat better as compared with Samples 1 to 7, but the level of improvement thereof is not sufficient and significantly inferior to that of Sample Nos. 12–23.

On the other hand, it was found that where the sensitizing dyes represented by Formula (I) were used in combination with the thiocyanic acid salts as in Samples 12 to 16, the sharpness is markedly improved and further that the stain before and after storage is small as well. This improved effect on sharpness was particularly notable in the samples having an optical reflection density provided in the light-sensitive material of 0.5 or more.

Further, it was found from the results of Samples 17 to 23 that the effects of the present invention remains unchanged even if the kinds of the thiocyanic acid salts and/or the type of sensitizing dyes represented by formula (I) are changed.

Thus, a silver halide color photographic light-sensitive material can be obtained according to the present invention, capable of providing an excellent rapid processing property and sharpness as well as forming little stain on a background before and after storage following processing.

Further, the light-sensitive material of the present invention is improved in safelight safety at about 590 nm and can provide large advantages in operability in manufacturing and a development processing.

It should be evident that various modifications can be made to the described embodiments without departing from the scope of the present invention.

What is claimed is:

1. A silver halide color photographic material comprising a reflection support having provided thereon at least one of each of a yellow color developing silver halide emulsion layer, a magenta color developing silver halide emulsion layer and a cyan color developing silver halide emulsion layer, wherein the spectral sensitivity peaks of the emulsion layers reside in 400 to 490 nm, 530 to 570 nm and 660 to 720 nm, respectively; and wherein the cyan color developing silver halide emulsion layer comprises (1) a silver halide emulsion comprising silver halide selected from silver chloride, silver bromochloride, silver chloroiodide and silver bromochloroiodide, each having an average silver chloride content of 90 mol % or more, and (2) at least one thiocyanic acid salt compound, and wherein the spectral sensitivity peak of the cyan color developing silver halide emulsion layer is provided by a J-band absorption of a sensitizing dye represented by the following Formula (I):

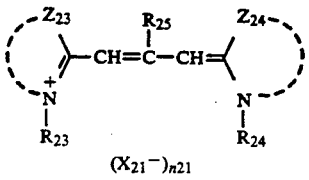

Formula (I)

wherein $Z_{23}$ and $Z_{24}$, which may be the same or different, each represents a group of atoms necessary to form a heterocyclic nucleus selected from a benzothiazole nucleus, a benzoselenazole nucleus, a naphthothiazole nucleus and a naphthoselenazole nucleus, each of which may have at least one substituent selected from a halogen atom, an alkyl group, an alkoxy group, an aryl group, and a hydroxyl group, provided that two of the substituents may be combined with each other to form a ring; $R_{25}$ represents an alkyl group or an aryl group; $R_{23}$ and $R_{24}$, which may be the same or different each represent a substituted or unsubstituted alkyl group; $X_{21}$ represents a counter ion; and $n_{21}$ is 0 or 1.

2. The silver halide color photographic material as in claim 1, wherein the sensitizing dye represented by formula (I) is present in an amount of from $1\times10^{-6}$ to $1\times10^{-3}$ mole dye per mole of silver halide.

3. The silver halide color photographic material as in claim 1, wherein said thiocyanic acid salt compound is selected from the group consisting of thiocyanic acid alkali metal salts, thiocyanic acid alkali earth salts and thiocyanic acid ammonium salts.

4. The silver halide color photographic material as in claim 1, wherein said thiocyanic acid salt compound is selected from the group consisting of potassium thiocyanate, sodium thiocyanate, calcium thiocyanate, magnesium thiocyanate and ammonium thiocyanate.

5. A silver halide color photographic material as in claim 1, wherein said thiocyanic acid salt compound is present in an amount of $2.5\times10^{-5}$ to $2\times10^{-2}$ mole per mole of silver halide.

6. A silver halide color photographic material as in claim 1, wherein said material has an optical reflection density of 0.50 to 2.0 in a measuring wavelength of 680 nm.

7. The silver halide color photographic material as in claim 5, further comprising a sharpness improving dye selected from the group consisting of an oxonol dye having a pyrazolone nucleus or a barbituric acid nucleus, an azo dye, an azomethine dye, an arylidene dye, a syryl dye, a triarylmethane dye, a merocyanine dye, and a cyanine dye.

8. The silver halide color photographic material as in claim 1, wherein said yellow color developing silver halide emulsion layer, said magenta color developing silver halide emulsion layer and said cyan color developing silver halide emulsion layer each comprises silver halide having an average silver chloride content of at least 95 mol %.

9. The silver halide color photographic material as in claim 1, wherein the reflective support comprises a water-resistant resin containing layer comprising 12% by weight or more of titanium oxide which has been subjected to a surface treatment with di- to tetrahydric alcohols before incorporation into said water-resistant resin containing layer.

10. The silver halide color photographic material as in claim 1, wherein said thiocyanic acid salt compound is added after the formation of silver halide grains in said silver halide emulsion.

* * * * *